United States Patent [19]

Nishio et al.

[11] 4,164,478

[45] Aug. 14, 1979

[54] PROCESS FOR IMPROVING GRANULAR DETERGENTS

[75] Inventors: Hiroshi Nishio, Chiba; Ryuichi Nakagawa, Narashino; Takashi Ikeuchi, Funabashi, all of Japan

[73] Assignee: The Lion Fat & Oil Co., Ltd., Tokyo, Japan

[21] Appl. No.: 884,837

[22] Filed: Mar. 9, 1978

[30] Foreign Application Priority Data

Mar. 18, 1977 [JP] Japan ..... 52/29269

[51] Int. Cl.[2] ..... C11D 1/12; C11D 3/12; C11D 11/00

[52] U.S. Cl. ..... 252/135; 252/109; 252/113; 252/133; 252/531; 252/532; 252/535; 252/536; 252/538; 252/539

[58] Field of Search ..... 252/89, 109, 135, 550, 252/531, 551, 532, 555, 536, 558, 539, 535, 538, 113, 133

[56] References Cited

U.S. PATENT DOCUMENTS

| | | | |
|---|---|---|---|
| 3,758,408 | 9/1973 | Ramachandran et al. | 252/89 |
| 3,951,877 | 4/1976 | Okumura et al. | 252/526 |
| 3,954,649 | 5/1976 | Lamberti | 252/174 |
| 3,957,695 | 5/1976 | Davies et al. | 252/532 |
| 3,979,314 | 9/1976 | Child | 252/140 |
| 3,989,635 | 11/1976 | Toyoda et al. | 252/135 |
| 4,009,114 | 2/1977 | Yurko | 252/109 |
| 4,022,702 | 5/1977 | Curtis | 252/89 R |
| 4,040,988 | 8/1977 | Benson et al. | 252/532 |
| 4,075,117 | 2/1978 | Morton et al. | 252/135 |

*Primary Examiner*—P. E. Willis, Jr.
*Attorney, Agent, or Firm*—Blanchard, Flynn, Thiel, Boutell & Tanis

[57] ABSTRACT

A process for reducing adhesion of water-insoluble substances onto washed cloth by causing water-insoluble inorganic powder having an average particle diameter of less than 1.5 micron and selected from the group consisting of magnesium oxide, aluminum hydroxide, calcium carbonate, heavy, white carbon and titanium oxide to adhere to the surfaces of the particles of a silicate-containing granular detergent in an amount of 0.3 to 5 parts by weight of said powder per 100 parts by weight of said granular detergent.

9 Claims, No Drawings

PROCESS FOR IMPROVING GRANULAR DETERGENTS

BACKGROUND OF THE INVENTION

The present invention relates to a process for improving granular detergents. To be more precise, it relates to a process for reducing the quantity of water-insoluble substances which would adhere to the wash at the time of washing with a granular detergent containing anionic surface active agent, alkali metal silicate and alkali metal carbonate, which process involves surface treatment of said granular detergent.

Ever since it was pointed out that phosphates which had been prevalently employed as inorganic builder for granular detergents cause environmental pollution, the work of reducing the phosphorus content of granular detergents has been positively undertaken in the detergent manufacturing industry. As an art of minimizing the phosphorus content from this point of view, there is known the art of employing silicate and carbonate of an alkali metal jointly as inorganic builder and reducing the quantity of the alkali metal phosphate to be employed. There have been developed several granular detergents with low phosphorus content embodying this art.

However, inasmuch as the alkali metal silicate has a reactivity with carbonic acid gas to form water-insoluble substances, these granular detergents tend to absorb carbonic acid gas from the air while in storage, for instance, and to form water-insoluble substances within the detergents. When water-insoluble substances are thus formed, they not only impair the detergency of the granular detergent per se, but also they adhere to the fabrics washed with the detergent, thereby causing the commercial value of the granular detergent to be reduced.

SUMMARY OF THE INVENTION

The present invention is intended to eliminate the afore mentioned defects, which are inevitable for a granular detergent containing alkali metal silicate and alkali metal carbonate as inorganic builder, by causing water-insoluble inorganic fine powder to adhere to the surfaces of the particles of said granular detergent. A granular detergent provided by the present invention has a large content of water-insoluble substances per unit weight compared with a granular detergent not covered with inorganic powder. However, when the granular detergent of the present invention is employed in actual washing, the amount of water-insoluble substances that adhere to the washed cloth is less than occurs when there is used a granular detergent not covered with inorganic powder, as is illustrated in the Examples to be described later on. The reason for this is, presumably, that because the covering inorganic powder is so fine, it scarcely adheres to the washed cloth, and the alkali metal silicate contained in the granular detergent is rather restrained from forming a water-insoluble substance as a result of being covered with inorganic fine powder.

According to the present invention, a water-insoluble inorganic fine powder having an average particle diameter of less than 1.5 micron and which is selected from the group consisting of magnesium oxide, aluminum hydroxide, calcium carbonate, heavy, white carbon and titanium oxide is employed as a covering material for detergent particles. The covering material in the present invention is required to have an average particle diameter of less than 1.5 micron; in the case where a covering material having an average particle diameter exceeding 1.5 micron is employed, there is a risk of said covering material adhering to the washed cloth. The appropriate quantity of the covering material to be employed is in the range of from 0.3 to 5 parts by weight, preferably from 0.3 to 4 parts by weight, per 100 parts by weight of the granular detergent; employment of the covering material in excess of 5 parts by weight is undesirable as there is a risk of its causing adhesion of the covering material onto the washed cloth.

Adhesion of the covering material onto the surfaces of the detergent particles can be effected by the method of mixing the granular detergent with the covering material by the use of a rotary mixing machine or a vibrating mixing machine as well as an optional method employing a pan granulator, a tumbling granulator or a vibrating granulator.

The improving process of the present invention is applicable to any granular detergent containing at least an anionic surface active agent as a active ingredient, together with alkali metal silicate and alkali metal carbonate as inorganic builder. In this connection, to cite anionic surface active agents prevalently employed for granular detergents, there are (a) alkylbenzene sulfonates wherein the alkyl has 8 to 15 carbon atoms, (b) alkyl sulfates wherein the alkyl has 8 to 18 carbon atoms, (c) alkyl ether sulfates wherein the alkyl has 8 to 18 carbon atoms and contains an average of 1 to 8 ethylene oxide units added thereto, (d) $\alpha$-olefin sulfonates obtained from $\alpha$-olefins having 12 to 22 carbon atoms (which may contain alkene sulfonates and hydroxyalkane sulfonates), (e) alkane sulfonates obtained from paraffin having 12 to 22 carbon atoms, (f) salts of higher fatty acids, (g) salts of condensates consisting of higher fatty acids and taurine (N-acyl aminoethane sulfonate), (h) salts of sulfosuccinic acid dialkyl ester, etc. In this context, it is appropriate to employ these anionic surface active agents in the form of their alkali metal salts, and in the case of sulfonate- and sulfate-type anionic surface active agents, it is also appropriate to employ them in the form of their magnesium salts. Granular detergents usually contain one or more than two of the aforementioned anionic surface active agents to the extent of 10 to 40 wt.%. Granular detergents containing non-ionic surface active agents and/or amphoteric surface active agents in addition to anionic surface active agents can also be objects of the surface treatment under the present invention. As non-ionic surface active agents of this sort, there can be mentioned polyoxyethylene alkyl ethers, polyoxyethylene alkylphenol ethers, polyoxyethylene fatty acid esters, polyoxyethylene sorbitan fatty acid esters, sucrose fatty acid esters, fatty acid alkylol amides, etc. As amphoteric surface active agents, there can be mentioned betaine-type surfactants, e.g., lauryl dimethyl carboxymethyl ammonium betaine, etc., alanine-type surfactants and imidazoline-type surfactants.

Granular detergents to be treated by the process of the present invention can contain alkali metal phosphate (e.g., tripolyphosphate, pyrophosphate, etc.) and/or alkali metal bicarbonate, in addition to alkali metal silicates of ($M_2O.xSiO_2$, wherein x=2.0 to 3.6 and M represents alkali metal) and alkali metal carbonates (e.g., $M_2CO_3$, wherein M represents alkali metal) as inorganic builders. However, in the case of granular detergents with low phosphorus content, the content of alkali metal phosphate therein is usually set at less than 15 wt.%, and therefore, when granular detergents of this kind are to be subjected to the process of the present invention, it is desirable that the content of alkali metal silicate therein be in the range of 4 to 20 wt.% and the content of alkali metal carbonate be in the range of 2 to 40 wt.%.

Granular detergents to be subjected to the process of the present invention can additionally contain organic builders illustrated by citrates, malates, tartrates, maleic acid polymers, alkyl-substituted succinates, oxydiacetates, etc. Likewise, granular detergents containing water-soluble sulfates, anti-redeposition agents (e.g., carboxymethyl cellulose, polyethylene glycol, polyvinyl alcohol, etc.), foam-controlling agents, fluorescent whitening agents, bleaching agents, dyes, perfumes, etc. as additional ingredients can also be subjected to the process of the present invention.

EXAMPLE 1

Table - 1

| Detergent Composition (wt.%) | A | B | C | D |
|---|---|---|---|---|
| sodium alkylbenzene sulfonate (R: about $C_{12}$) | 15 | 10 | 10 | 5 |
| sodium α-olefin sulfonate (R: $C_{14}$ to $C_{18}$) | — | 10 | 10 | 20 |
| sodium alkyl polyoxyethylene ether sulfate (R: $C_{14}$ to $C_{15}$, $\bar{p}$ = about 3) | 5 | 5 | — | — |
| sodium alkyl sulfate (R: $C_{12}$ to $C_{15}$) | 5 | — | 5 | 5 |
| sodium tripolyphosphate | 15 | 15 | — | — |
| sodium pyrophosphate | — | — | 12 | — |
| sodium silicate ($SiO_2/Na_2O$ = 2.8/1) | 18 | 15 | 7 | 15 |
| sodium carbonate | — | 3 | 11 | 35 |
| sodium sulfate | 30 | 32 | 32 | 9 |
| others* | 2 | 2 | 3 | 3 |
| water | 10 | 8 | 10 | 8 |

*Anti-redeposition agents, foam-controlling agents and flourescent whitening agents are included.

A variety of granular detergents having compositions as shown in Table-1 above, respectively, and an average particle diameter in the range of from 350 to 450 microns were manufactures by the spray drying method. Subsequently, by adding a prescribed quantity of magnesium oxide powder having a prescribed particle diameter to the respective granular detergents and mixing together by means of a V-type mixer for 5 minutes, said magnesium oxide powder was caused to adhere to the surfaces of the detergent particles sufficiently.

Each granular detergent after the surface treatment in this way was then subjected to a water-insoluble substance quantitative test and an adhesion-to-cloth test as described in the following.

Water-insoluble substance quantitative test:

After packing a quantity of the sample granular detergent in a carton for detergent (measuring 22cm×15.5cm×5.5cm and having a water vapor permeability of 50 g/m²/24 hrs) and sealing the carton hermetically, the carton was stored in a test chamber. Next, the air within the test chamber was replaced with water-saturated carbonic acid gas, and thereafter water-saturated carbonic acid gas was blown into the test chamber at a constant flux of 1.5 l/min. for 8 hours. In this context, the foregoing treatment within the test chamber is equivalent to permitting said carton to stand in the normal atmosphere for about 1.5 year.

After completion of the blowing, a fixed quantity of the detergent was taken out of the carton by weighing exactly and was put in a test tube. Then, after adding thereto about 30 ml of hot water and dissolving the soluble substance contained in the detergent with a water bath (temperature: 90° C.), the water-insoluble substance contained therein was recovered through centrifugal separation. Subsequently, this operation of adding hot water to the water-insoluble substance and centrifugally separating the remaining water-soluble substance was repeated twice, and the finally obtained water-insoluble substance was dried at a temperature of 105° C. for 2 hours to attain the constant weight thereof. From this constant weight was sought the ratio of the water-insoluble substance contained in the detergent.

Adhesion-to-cloth test:

By employing the same granular detergent as that used in the water-insoluble substance quantitative test, dark-colored shirts, socks, towels, etc. were washed with an impeller-type electric washing machine. On this occasion, the condition for washing were as follows: the concentration of detergent: 0.084%, the water used: city water, the quantity of liquid: 30l, the loading ratio: 30, the temperature: 25° C., the time for washing: 10 minutes. Rinsing was performed twice for 3 minutes each by applying the same conditions as that for washing save for the use of city water containing no detergent. After completing the washing, the washed cloth was dried naturally, and then the adhering substances on every washed cloth were swept away and collected on a black paper for evaluation on the following bases.

A: No adhering substance was observed.

B: Just a trace of adhering substances was observed.

C: Adhering substances were observed.

D: A lot of adhering substances were observed.

On Table-2 are shown the result of each test conducted as above, together with the average particle diameter of the magnesium oxide powder employed as well as the quantity thereof used.

Table - 2

| Experiment No. | | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|---|
| detergent composition | | A | B | B | B | B | B | B | B | B | B | C | C | C | C | D | D | D | D |
| magnesium oxide | average particle diameter of particles (μ) | — | 1.0 | 1.0 | 1.0 | 1.0 | 1.0 | 1.0 | 0.5 | 3.0 | 6.0 | — | 1.0 | 1.0 | 4.0 | — | 1.0 | 1.0 | 4.0 |
| | quantity* added | 0 | 0.1 | 0.3 | 2.0 | 4.0 | 5.0 | 7.0 | 2.0 | 2.0 | 2.0 | 0 | 2.0 | 7.0 | 2.0 | 0 | 2.0 | 7.0 | 2.0 |
| water-insoluble** substances (%) | | 5.3 (5.3) | 3.6 (3.5) | 2.4 (2.1) | 4.0 (2.0) | 5.9 (2.1) | 6.9 (2.1) | 8.8 (2.3) | 4.0 (2.0) | 4.3 (2.3) | 4.3 (2.3) | 3.1 (3.1) | 3.9 (1.9) | 8.7 (2.2) | 4.3 (2.3) | 3.2 (3.2) | 4.0 (2.0) | 8.8 (2.3) | 4.2 (2.2) |

Table - 2-continued

| Experiment No. | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| detergent composition | A | B | B | B | B | B | B | B | B | B | C | C | C | C | D | D | D | D |
| evaluation of adhering substances | D | C | A | A | A | B | C | A | C | C | C | A | C | C | C | A | C | C |

*Part by weight per 100 parts by weight of granular detergent.
**The bracketed figure represents the quantity of the water-insoluble substances arising from sodium silicate.

As is evident from the data shown in Table-2, a granular detergent of composition A which contains sodium silicate and does not contain sodium carbonate gives rise to a lot of water-insoluble substance as a result of reaction between sodium silicate and carbonic acid gas (cf. Experiment No. 1). Whereas, in the case of a granular detergent of composition B, C and D, respectively, which contains both sodium silicate and sodium carbonate, it is possible to reduce the water-insoluble substances arising from sodium silicate and accordingly lower the degree of adhesion of the water-insoluble substances to the wash through surface treatment of said detergent with magnesium oxide powder as far as the average particle diameter of said magnesium oxide powder is less than 1.5 micron and the quantity of magnesium oxide applied is in the range of from 0.3 to 5 parts by weight per 100 parts by weight of the granular detergent (cf. Experiment Nos. 3 through 6, 8 12 and 16). In this connection, in the case where magnesium oxide is not employed (cf. Experiment Nos. 1, 11 and 15) and the quantity of magnesium oxide employed is too small even when applied (cf. Experiment No. 2), it is infeasible to cover the whole surfaces of the detergent particles sufficiently, and accordingly, it is impossible to prevent sodium silicate from becoming water-insoluble, resulting in adhesion of the water-insoluble substances onto the washed cloth. In the case where the average particle diameter of the magnesium oxide is too large (cf. Experiment Nos. 9, 10, 14 and 18) and the quantity of magnesium oxide employed is excessive (cf. Experiment Nos. 7, 13 and 17), magnesium oxide per se would adhere to the washed cloth. Therefore both cases are undesirable.

EXAMPLE 2.

Granular detergent having the detergent composition B shown in Table-1 was subjected to surface treatment with aluminum hydroxide powder, calcium carbonate powder, heavy, white carbon powder, titanium oxide powder, etc. respectively, in the same way as in Example 1, and the resulting various detergents were subjected to the same water-insoluble substance quantitative test and adhesion-to-cloth test as in Example 1.

The result was as shown in Table - 3.

The data shown in Table-3 indicate that such inorganic powders as aluminum hydroxide, calcium carbonate, heavy, white carbon, titanium oxide, etc. would yield a good result as surface treating agent for granular detergents, like magnesium oxide powder, subject to setting the average particle diameter and the quantity thereof to be employed at a proper value, respectively.

What is claimed is:

1. A process for treating detergent granules containing from 10 to 40% by weight of organic, water-soluble, anionic, synthetic surface active agent, from 4 to 20% by weight of water-soluble alkali metal silicate and from 2 to 40% by weight of water-soluble alkali metal carbonate, so that reaction between said alkali metal silicate and carbon dioxide in the ambient atmosphere is inhibited, which comprises: mixing with the preformed detergent granules from 0.3 to 5 parts by weight, per 100 parts by weight of said detergent granules, of a powder of water-insoluble agent selected from the group consisting of magnesium oxide, aluminum hydroxide, calcium carbonate, heavy white carbon and titanium oxide, said agent having an average particle diameter of less than 1.5 microns, and thereby adhering said powder to the surfaces of said granules in the form of an external covering thereon.

2. A process according to claim 1, in which the amount of said agent is from 0.3 to 4 parts by weight, per 100 parts by weight of said detergent granules.

3. A process according to claim 1 wherein said detergent granules contain less than 15% by weight of alkali metal phosphate builder salt.

4. A process according to claim 1 wherein said alkali metal silicate has the formula $M_2O.XSiO_2$, wherein X is from 2.0 to 3.6 and M is an alkali metal.

5. A process according to claim 1 or claim 2 wherein said agent consists of magnesium oxide.

6. A process according to claim 1 or claim 2 wherein said agent consists of aluminum hydroxide.

7. A process according to claim 1 or claim 2 wherein said agent consists of calcium carbonate.

8. A process according to claim 1 or claim 2 wherein said agent consists of heavy white carbon.

9. A process according to claim 1 or claim 2 wherein said agent consists of titanium oxide.

* * * * *

Table - 3

| Experiment No. | 19 | 20 | 21 | 22 | 23 | 24 | 25 | 26 | 27 | 28 | 29 | 30 |
|---|---|---|---|---|---|---|---|---|---|---|---|---|
| inorganic powder | aluminum hydroxide | | | calcium carbonate, heavy | | | white carbon | | | titanium oxide | | |
| average particle diameter (μ) | 1.0 | 1.0 | 4.0 | 1.0 | 1.0 | 4.0 | 1.0 | 1.0 | 4.0 | 1.0 | 1.0 | 4.0 |
| quantity added* | 2.0 | 7.0 | 2.0 | 2.0 | 7.0 | 2.0 | 2.0 | 7.0 | 2.0 | 2.0 | 7.0 | 2.0 |
| water-insoluble** substances (%) | 4.0 (2.0) | 8.8 (2.3) | 4.3 (2.3) | 3.9 (1.9) | 8.7 (2.2) | 4.3 (2.3) | 3.9 (1.9) | 8.7 (2.2) | 4.2 (2.2) | 4.0 (2.0) | 8.7 (2.2) | 4.2 (2.2) |
| evaluation of adhering substances | A | C | C | A | C | C | A | C | C | A | C | C |

*Part by weight per 100 parts by weight of granular detergent.
**The bracketed figure represents the quantity of the water-insoluble substances arising from sodium silicate.